US007832902B2

(12) United States Patent
Belliveau et al.

(10) Patent No.: US 7,832,902 B2
(45) Date of Patent: Nov. 16, 2010

(54) HEAT RESISTANT COLOR MIXING FLAG FOR A MULTIPARAMETER LIGHT

(75) Inventors: Richard S. Belliveau, Austin, TX (US); Keith Dennis Cannon, Georgetown, TX (US)

(73) Assignee: Barco Lighting Systems, Inc., Austin, TX (US)

( * ) Notice: Subject to any disclaimer, the term of this patent is extended or adjusted under 35 U.S.C. 154(b) by 309 days.

(21) Appl. No.: 11/765,539

(22) Filed: Jun. 20, 2007

(65) Prior Publication Data

US 2008/0316746 A1 Dec. 25, 2008

(51) Int. Cl.
*F21V 17/02* (2006.01)

(52) U.S. Cl. ..... 362/283; 362/282; 362/322; 362/293

(58) Field of Classification Search ..... 362/277, 362/269–271, 281, 283, 284, 233, 280, 293, 362/294, 321, 324, 371, 282, 322
See application file for complete search history.

(56) References Cited

U.S. PATENT DOCUMENTS

| | | | | |
|---|---|---|---|---|
| 4,392,187 | A | 7/1983 | Bornhorst | 362/233 |
| 4,914,556 | A | 4/1990 | Richardson | 362/293 |
| 4,958,265 | A | 9/1990 | Solomon | 362/293 |
| 4,984,143 | A | 1/1991 | Richardson | 362/293 |
| 5,515,254 | A | 5/1996 | Smith | 362/293 |
| 5,825,548 | A * | 10/1998 | Bornhorst et al. | 359/578 |
| 5,969,868 | A * | 10/1999 | Bornhorst et al. | 359/589 |
| 6,048,080 | A * | 4/2000 | Belliveau | 362/282 |
| 6,687,063 | B1 | 2/2004 | Rasmussen | 359/887 |
| 6,796,683 | B2 * | 9/2004 | Wood et al. | 362/281 |
| 7,163,317 | B2 * | 1/2007 | Warnecke et al. | 362/281 |
| 2003/0067588 | A1 * | 4/2003 | Belliveau | 353/31 |
| 2003/0076681 | A1 * | 4/2003 | Rasmussen et al. | 362/280 |
| 2003/0193653 | A1 * | 10/2003 | Belliveau | 353/31 |
| 2006/0034089 | A1 * | 2/2006 | Rasmussen et al. | 362/382 |
| 2008/0062681 | A1 * | 3/2008 | Belliveau et al. | 362/231 |
| 2008/0062683 | A1 * | 3/2008 | Belliveau et al. | 362/231 |

FOREIGN PATENT DOCUMENTS

WO WO 9957486 A1 * 11/1999

OTHER PUBLICATIONS

"Any Color Any Time", Lighting Dimensions, Aug. 2004.

* cited by examiner

*Primary Examiner*—Thomas M Sember
(74) *Attorney, Agent, or Firm*—Walter J. Tencza, Jr.

(57) ABSTRACT

A dichroic color mixing flag for a multiparameter light is constructed that greatly improves the thermal shock tolerance of the flag and avoids having to use a more costly quartz substrate material. The dichroic color mixing flag may be substantially circular in shape. The dichroic color mixing flag may be fixed to a mechanical component so that the flag cannot rotate with respect to the mechanical component. The dichroic color mixing flag may be fixed to the mechanical component so that the mechanical component can move the dichroic color mixing flag without moving any other dichroic color mixing flag.

9 Claims, 4 Drawing Sheets

HEAT RESISTANT COLOR MIXING FLAG FOR A MULTIPARAMETER LIGHT

FIELD OF THE INVENTION

This invention relates to multiparameter lighting fixtures.

BACKGROUND OF THE INVENTION

Multiparameter lighting fixtures are lighting fixtures, which illustratively have two or more individually remotely adjustable parameters such as focus, color, image, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks. Illustrative multi-parameter lighting fixtures are described in the product brochure showing the High End Systems product line for the year 2000 and are available from High End Systems, Inc. of Austin, Tex.

Multiparameter lighting fixtures are commonly constructed with a lamp housing that may pan and tilt in relation to a base housing so that light projected from the lamp housing can be remotely positioned to project on a stage surface. Commonly a plurality of multiparameter lights are controlled by an operator from a central controller. The central controller is connected to communicate with the plurality of multiparameter lights via a communication system. U.S. Pat. No. 4,392,187 titled "Computer controlled lighting system having automatically variable position, color, intensity and beam divergence" to Bornhorst, incorporated herein by reference, discloses a plurality of multiparameter lights and a central controller.

The lamp housing of the multiparameter light contains the optical components and the lamp. The lamp housing is rotatably mounted to a yoke that provides for a tilting action of the lamp housing in relation to the yoke. The lamp housing is tilted in relation to the yoke by a motor actuator system that provides remote control of the tilting action by the central controller. The yoke is rotatably connected to the base housing that provides for a panning action of the yoke in relation to the base housing. The yoke is panned in relation to the base housing by a motor actuator system that provides remote control of the panning action by the central controller.

It is desirable for a multiparameter light to have a high intensity light output and a remotely variable color system. The use of dichroic filters to color the light emitted by a multiparameter theatre lighting fixture is known in the art. U.S. Pat. No. 4,392,187 to Bornhost, discloses the use of dichroic filters in a multiparameter light. Bornhorst writes "The dichroic filters transmit light incident thereon and reflect the complement of the color of the transmitted beam. Therefore, no light is absorbed and transformed to heat as found in the prior art use of celluloid gels. The use of a relatively low power projection lamp in lights 30 and 110 substantially reduces the generation of infrared radiation which causes high power consumption and heat buildup within prior art devices."

Bornhorst U.S. Pat. No. 4,392,187 was filed in March 1981 and since that time the use of dichroic filters to color the light emitted by a multiparameter stage light is generally practiced in the art. One thing has continued to change however. There is an on going demand within the theatre industry for ever increasing light output levels from multiparameter theater lights. Therefore, the projection lamp source for the modern day multiparameter light has been increasing in power and light output. For example while the lamp 50 disclosed by Bornhorst is a common projector lamp having a power consumption of 350 watts, there is a demand today for multiparameter lights utilizing lamps that have a power consumption of 2000 Watts and over.

Bornhorst discloses color wheels 112 and 114 that have dichroic filters mounted thereon and permit the coloring of the light emitted by a lamp 50. While the use of color wheels that support multiple wavelengths of dichroic filters to color the light of a multiparameter stage light is still in common practice, it is also common practice to construct a multiparameter light having variable density dichroic filter flags that gradually color the light using a subtractive color method. The subtractive color method may use the dichroic filter flag colors of cyan, magenta and yellow to gradually and continuously vary the color of today's multiparameter stage light producing a pleasing color fade when visualized by an audience. The gradual and continuous varying of cyan, magenta and yellow in the light path of a multiparameter light is referred to as "CMY color mixing" in the theatrical art.

U.S. Pat. No. 6,687,063 to Rasmussen discloses a dichroic color mixing filter flag system for use with a multiparameter light color mixing system. Rasmussen discloses a dichroic color mixing flag in FIGS. 8 and 12 with dichroic etched fingers that operate to produce a variable color as they are translated across the light created by the optical path.

Current state of the art dichroic color mixing flags are constructed of a low expansion borosilicate glass substrate. The low coefficient of expansion of the borosilicate glass substrate helps to provide a reasonable tolerance to thermal shock as the dichroic color mixing flag is translated or moved into and out of the high energy light created by the optical path. A low expansion borosilicate glass substrate use in the manufacture of dichroic filter flags is commercially available from Schott America, 555 Taxter Road, Elmsford, N.Y. and is referred to as Schott Borofloat.

The inventors of the present application have noticed during development of new multiparameter stage lights using lamps having a wattage of 2000 watts and over, that the dichroic color mixing flags of the present art constructed on the present art borosilicate substrate are subject to even greater thermal shock and therefore can crack when used with such high intensity light sources. One prior art way to improve the thermal (or heat) resistance of the present art dichroic color mixing flag is to construct the dichroic filter material out of a substrate with an even lower coefficient of thermal expansion than the typical borosilicate. Unfortunately, in the prior art, this improved alternate type of substrate is usually constructed from a high purity quartz, which can be very custom and be quite expensive.

SUMMARY OF THE INVENTION

At least one embodiment of the present invention includes a method of constructing a dichroic color mixing flag for a multiparameter light that greatly improves the thermal shock tolerance of the flag and avoids having to use a more costly quartz substrate material as in the prior art.

At least one embodiment of the present invention includes a novel method of improving the shock tolerance of a color mixing flag used in a multiparameter light.

DETAILED DESCRIPTION OF THE DRAWINGS

Figure 1:
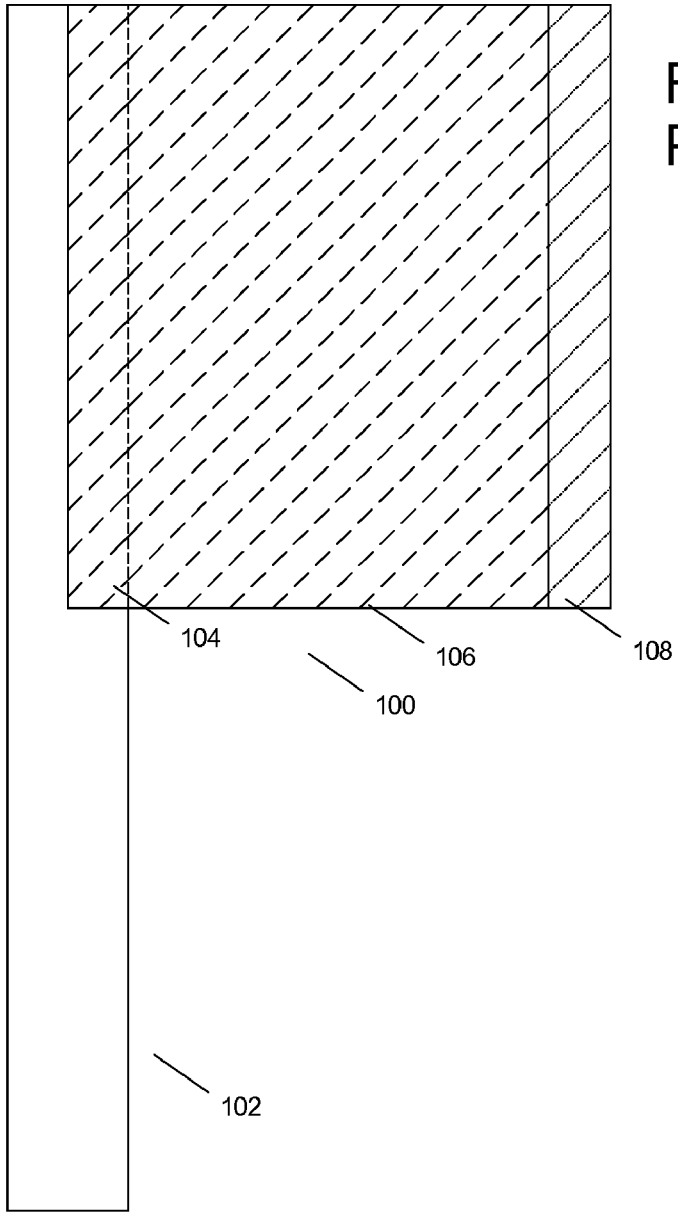
FIG 1 Prior Art
FIG. 1 shows a simplified diagram of a prior art dichroic color mixing flag.

FIG. 1 shows a simplified diagram of a dichroic color mixing flag 100 of the prior art. The dichroic color mixing flag 100 is fixed to a mechanical component, such as mechanical arm 102 used as a holder and for translation into a path of light from a multiparameter light. The fixing of the color mixing flag 100 may be through or by any suitable way known in the art such as by high temperature silicone adhesive to area 104 of the mechanical arm 102. The flag 100 has a graduated area 108 where a dichroic film is patterned to aid in the gradual color mixing when the dichroic color mixing flag 100 is translated into the path of light from a multiparameter light as known in the art. The flag 100 also has an area 106.

Figure 2A:
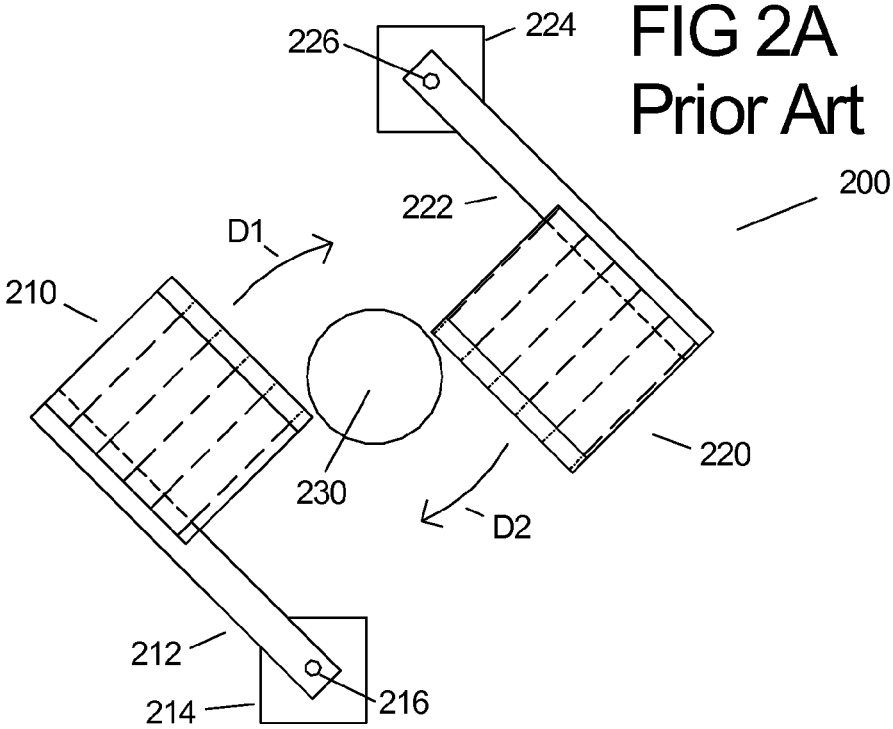
FIG 2A Prior Art
FIG. 2A shows a simplified diagram of a prior art system of dichroic color mixing flags in a first state.

FIG. 2A shows a simplified diagram of a dichroic color mixing system 200 of the prior art in a first state. The dichroic color mixing system 200 uses two dichroic color mixing flags 210 and 220 each of which is similar to dichroic color mixing flag 100 of FIG. 1. The dichroic color mixing flags 210 and 220 are fixed to mechanical components, such as mechanical arms 212 and 222, respectively, each of which may be the same arm as mechanical arm 102 of FIG. 1. The mechanical arm 212 is fixed to a motor shaft 216 of motor 214 so that the mechanical arm 212 and flag 210 may be variably translated in the direction D1 into the optical path of light 230. The mechanical arm 222 is fixed to motor shaft 226 of motor 224 so that the arm 222 and flag 220 may be variably translated in the direction D2 into the optical path of light 230. The optical path of light 230 is the path of light created by the optical system of a prior art multiparameter light.

Figure 2B:
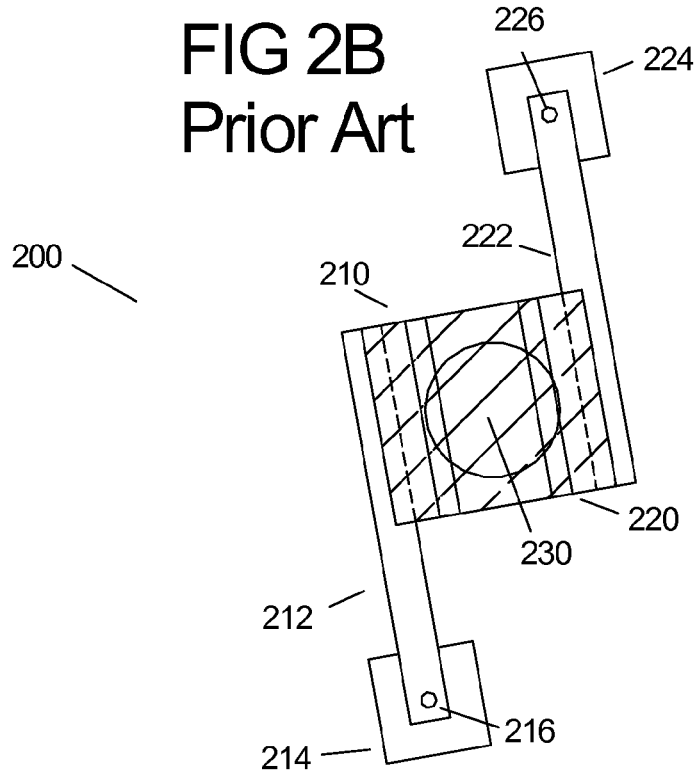
FIG 2B Prior Art
FIG. 2B shows a simplified diagram of the prior art system of color mixing flags of FIG. 2A in a second state.

FIG. 2B shows the dichroic color mixing system 200 in a second state. In the second state shown in FIG. 2B, the dichroic color mixing flags 210 and 220 have been fully translated into the optical path of light 230.

In the prior art, dichroic color mixing flags, such as 100, 210, or 220, have been constructed primarily rectangular or square in geometry. This is quite natural since it is desirable to have a long fixing area for gluing such as the area 104 of the flag 100. Generally, the term "color mixing flag" is associated by with a rectangular or a square shape. This can be easily seen when observing the geometry of the color mixing flags of FIG. 12 of U.S. Pat. No. 6,687,063 to Rasmussen and 505 of FIG. 5 of U.S. Pat. No. 6,796,683 to Wood for example. During the development of a high powered multiparameter light using a lamp of 2000 watts or greater the inventors of the present application realized that the prior art dichroic color mixing flags (such as flag 100 of FIG. 1) often cracked due to thermal stress when translated into a light path across such intense light. It was not desirable to change the substrate material to that of a lower expansion from a material like quartz because the price of the quartz substrate is quite expensive and not readily available.

Experimentation began with varying thicknesses of a borosilicate dichroic color mixing flag, to find a solution. The fixing or gluing area 104 used for the flag 100 of shown in FIG. 1 was altered as a means to allow the substrate further room for expansion as it was translated into the light path. An experiment to sectionalize the dichroic color mixing flag 100 of FIG. 1 into multiple smaller strips of material was tried without significant improvement of the flag as modified, to handle thermal stress when translated into a light path, such as 230 of FIG. 2B.

Figure 3:
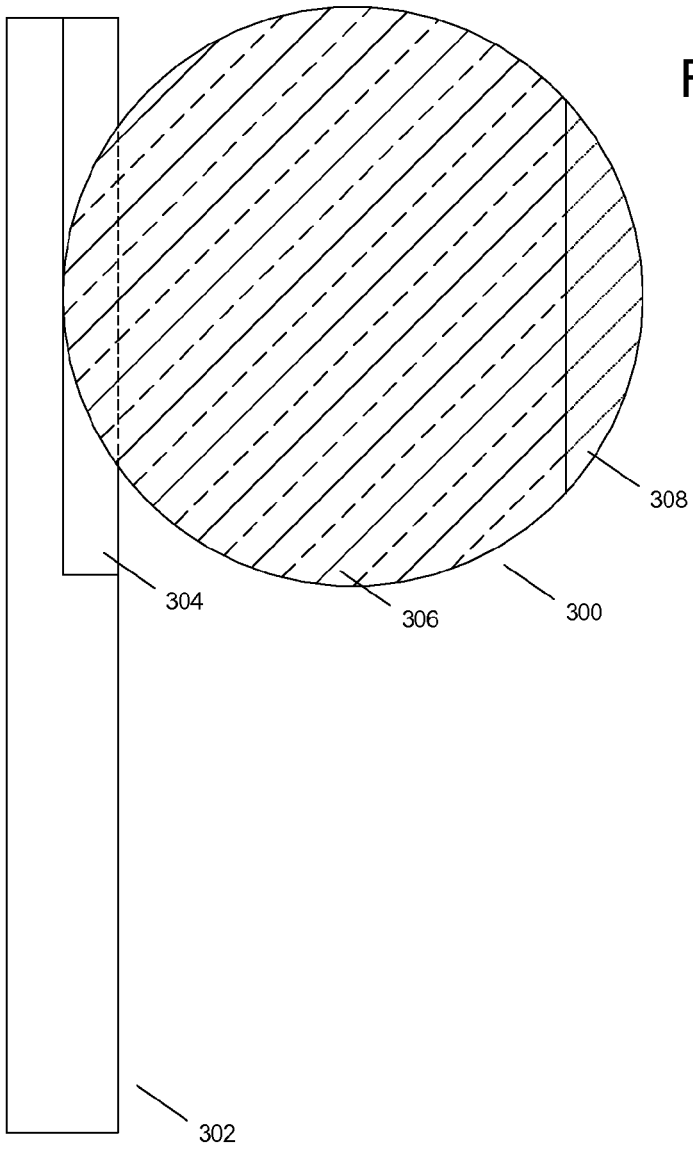
FIG. 3 shows a simplified diagram of a dichroic color mixing flag in accordance with an embodiment of the present invention.

The inventors found that a dichroic color mixing flag of a borosilicate substrate could be constructed that greatly improved the handling of thermal stress by altering the geometry of the color mixing flag 100 of the prior art. In one embodiment of the present invention a dichroic color mixing flag 300 is constructed having a substantially circular geometry. The color mixing flag 300 of FIG. 3 shows a great improvement to handling thermal stress in multiparameter lights with highpowered light sources. In one embodiment of the present invention, which may be preferred, a substantially circular dichroic color mixing flag 300 is provided. However, a dichroic color mixing flag that is substantially elliptical or substantially predominantly oval are also embodiments of the present invention, and will produce a somewhat improved color mixing flag over the prior art.

FIG. 3 shows the dichroic color mixing flag 300 of an embodiment of the present invention. The dichroic color mixing flag 300 is shaped to a substantially circular geometry. The dichroic color mixing flag 300 is fixed to a mechanical arm 302 used as a holder and for translation into a path of light from a multiparameter light. The fixing of the color mixing flag 300 may be any suitable way known to the art such as by high temperature silicone adhesive to an area 304 of the mechanical arm 302. The mechanical arm 302 of FIG. 3 may be similar in construction to the mechanical arm 102 of FIG. 1. The dichroic color mixing flag 300 has a graduated area 308 where dichroic film is patterned to aid in the gradual color mixing when the flag 300 is translated into the path of light of the high powered multiparameter light. The graduated area 308 may be etched and be a pattern of dots or areas of full saturation next to areas of no saturation. The flag 300 also has an area 306.

Figure 4A:
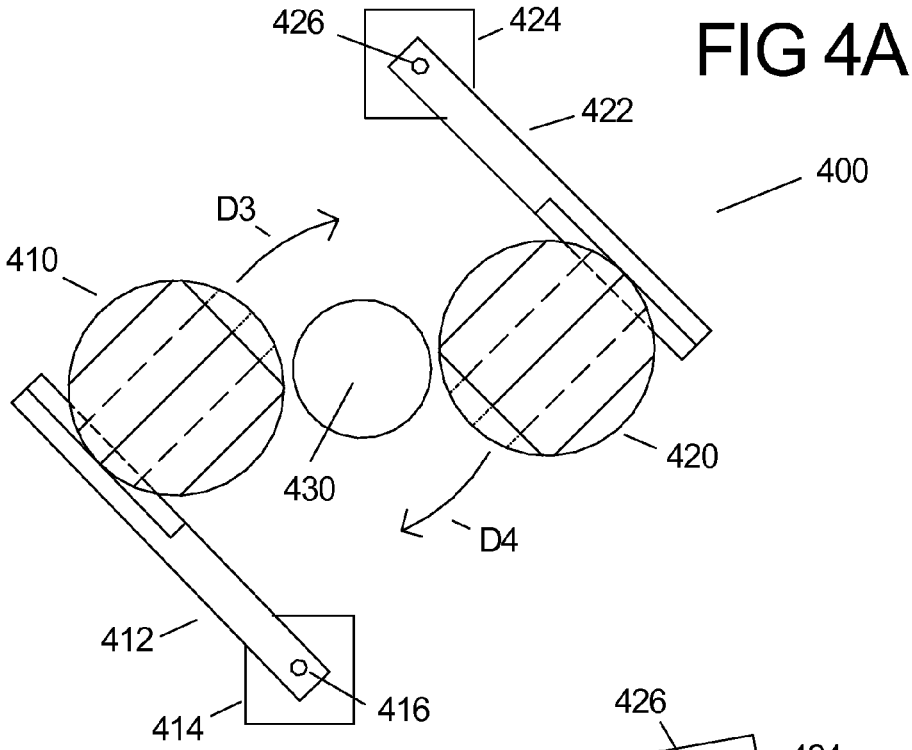
FIG. 4A shows a simplified diagram of a system of dichroic color mixing flags in accordance with another embodiment of the present invention in a first state, wherein the dichroic color mixing flags can be translated into a light path.

FIG. 4A shows a simplified diagram of a dichroic color mixing system 400 in accordance with an embodiment of the present invention in a first state. The dichroic color mixing system 400 uses two dichroic color mixing flags 410 and 420 each of which is similar to dichroic color mixing flag 300 of FIG. 3. The dichroic color mixing flags 410 and 420 are fixed to mechanical components, such as mechanical arms 412 and 422, respectively, each of which may be the same arm as mechanical arm 302 of FIG. 3. The mechanical arm 412 is fixed to a motor shaft 416 of motor 414 so that the mechanical arm 412 and flag 410 may be variably translated in the direction D3 into the optical path of light 430. The mechanical arm 422 is fixed to motor shaft 426 of motor 424 so that the arm 422 and flag 420 may be variably translated in the direction D4 into the optical path of light 430. The optical path of light 430 is the path of light created by the optical system of a multiparameter light.

Figure 4B:
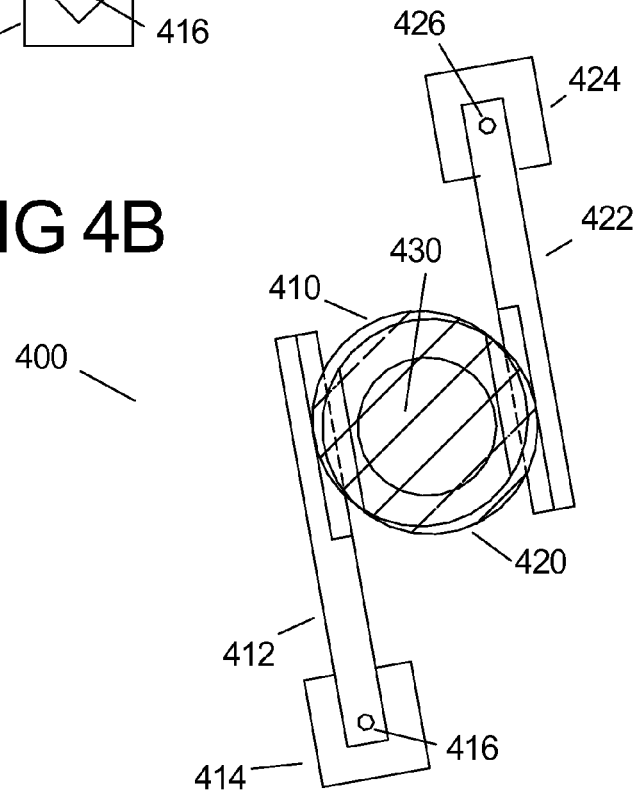
FIG. 4B shows a simplified diagram of the system of dichroic color mixing flags of FIG. 4A in a second state, wherein the dichroic color mixing flags have been translated into a light path.

FIG. 4B shows the dichroic color mixing system 400 in a second state. In the second state shown in FIG. 4B, the dichroic color mixing flags 410 and 420 have been fully translated into the optical path of light 430. The translation of the dichroic color mixing flags 410 and 420 may be accomplished, in one embodiment of the present invention, by rotation of the motor shafts 416 and 426 that drive the mechanical arms 412 and 422 to rotate, respectively. The mechanical arm 412 with the flag 410 and the mechanical arm 422 with the flag 420 are rotated into the optical path of the light 430.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising a dichroic color mixing system for a multiparameter stage light comprising:

a plurality of dichroic color mixing flags wherein each of the plurality of dichroic color mixing flags has a substantially circular shape having a perimeter and at least two of the plurality of dichroic color mixing flags have a transmitting color which is the same;

a plurality of mechanical components;

a plurality of motors, one for each of the plurality of mechanical components;

wherein each of the plurality of mechanical components is fixed to a periphery of a corresponding one dichroic color mixing flag of the plurality of dichroic color mixing flags in a manner so that each corresponding one dichroic color mixing flag of the plurality of dichroic mixing flags cannot rotate with respect to the mechanical component to which it is fixed;

wherein each mechanical component of the plurality of mechanical components can move the dichroic color mixing flag which is fixed to it into a light path without moving any other dichroic color mixing flag;

wherein each mechanical component of the plurality of mechanical components has a first end which is fixed to and in direct contact with its corresponding one dichroic color mixing flag at a first point inside the perimeter of the substantially circular shape of its corresponding one dichroic color mixing flag;

wherein each mechanical component of the plurality of mechanical components has a second end opposite the first end; and wherein each mechanical component of the plurality of mechanical components is fixed to its corresponding one dichroic color mixing flag so that each mechanical component of the plurality of mechanical components extends from its first end at the first point inside the perimeter of the substantially circular shape of its corresponding one dichroic color mixing flag to its second end at a second point outside the perimeter of the substantially circular shape of its corresponding one dichroic color mixing flag, wherein the second end of each of the plurality of mechanical components is not overlapped by the substantially circular shape of its corresponding one dichroic color mixing flag;

wherein the second end of each of the plurality of mechanical components is fixed to a corresponding one motor of the plurality of motors which is configured to a translate a corresponding one dichroic color mixing flag of the plurality of dichroic color mixing flags into the light path; and wherein each of the dichroic color mixing flags is fixed to the first end of its corresponding mechanical component and the second end of each of the corresponding mechanical components is fixed to its corresponding one motor of the plurality of motors so that each of the dichroic color mixing flags cannot rotate unless translated with respect to its corresponding one motor.

2. The apparatus of claim 1 wherein wherein the transmitting color of the at least two of the plurality of dichroic color mixing flags is any one of magenta, cyan or yellow.

3. An apparatus comprising a dichroic color mixing system for a multiparameter stage light comprising:

a plurality of dichroic color mixing flags each having a shape and each having a transmitting color;

a plurality of mechanical components; and wherein each of the plurality of mechanical components is fixed to a periphery of a corresponding one dichroic color mixing flag of the plurality of dichroic color mixing flags in a manner so that each corresponding one dichroic color mixing flag of the plurality of dichroic color mixing flags cannot rotate with respect to the mechanical component to which it is fixed;

wherein each mechanical component of the plurality of mechanical components is fixed to the periphery of the corresponding one dichroic color mixing flag of the plurality of dichroic color mixing flags in a manner so that each mechanical component can move the dichroic color mixing flag which is fixed to it without moving any other dichroic color mixing flag;

and further comprising a plurality of motors, one for each of the plurality of dichroic color mixing flags;

wherein each of the plurality of motors is connected to a corresponding one of the plurality of mechanical components;

wherein each of the plurality of dichroic color mixing flags has a substantially rounded shape having a perimeter;

wherein at least two of the plurality of dichroic color mixing flags have the same transmitting color;

wherein each of the dichroic color mixing flags is configured with respect to its corresponding one of the plurality of mechanical components, and corresponding one of the plurality of motors so that each of the dichroic color mixing flags can be translated into an optical path of the multiparameter stage light by its corresponding one of the plurality of mechanical components and its corresponding one of the plurality of motors;

wherein each mechanical component of the plurality of mechanical components has a first end which is fixed to and in direct contact with its corresponding one dichroic color mixing flag at a first point inside the perimeter of the substantially rounded shape of its corresponding one dichroic color mixing flag;

wherein each mechanical component of the plurality of mechanical components has a second end opposite the first end; and wherein each mechanical component of the plurality of mechanical components is fixed to its corresponding one dichroic color mixing flag so that each mechanical component of the plurality of mechanical components extends from its first end at the first point inside the perimeter of the substantially rounded shape of its corresponding one dichroic color mixing flag to its second end at a second point outside the perimeter of the substantially rounded shape of its corresponding one dichroic color mixing flag, wherein the second end of each of the plurality of mechanical components is not overlapped by the substantially rounded shape of its corresponding one dichroic color mixing flag;

wherein the second end of each of the plurality of mechanical components is fixed to a corresponding one of the plurality of motors which is configured to a translate its corresponding one dichroic color mixing flag of the plurality of dichroic color mixing flags into the optical path of the multiparameter stage light; and wherein each of the dichroic color mixing flags is fixed to the first end of its corresponding one mechanical component and the second end of each of the corresponding mechanical components is fixed to its corresponding one motor of the plurality of motors so that each of the dichroic color mixing flags cannot rotate unless translated with respect to its corresponding one motor.

4. A dichroic color mixing system for a multiparameter stage light comprising:

a plurality of dichroic color mixing flags, each having a substantially circular shape, and each having a transmitting color; and a plurality of mechanical components;

a plurality of motors, one for each of the plurality of mechanical components;

wherein at least two of the plurality of dichroic color mixing flags have the same transmitting color;

wherein each of the plurality of dichroic color mixing flags has a graduated area that produces a gradual color mixing when each of the plurality of dichroic color mixing flags is translated into a light path of the multiparameter stage light;

wherein a periphery of each of the plurality of dichroic color mixing flags is fixed to a corresponding one of the plurality of mechanical components in a manner so that each of the plurality of dichroic color mixing flags cannot rotate with respect to its corresponding one of the plurality of mechanical components;

wherein the periphery of each of the plurality of dichroic color mixing flags is fixed to the corresponding one of the plurality of mechanical components in a manner so that each mechanical component can move the dichroic color mixing flag which is fixed to it without moving any other dichroic color mixing flag;

wherein each mechanical component of the plurality of mechanical components has a first end which is fixed to and in direct contact with its corresponding one dichroic color mixing flag at a first point inside the perimeter of the substantially circular shape of its corresponding one dichroic color mixing flag;

wherein each mechanical component of the plurality of mechanical components has a second end opposite the first end; and wherein each mechanical component of the plurality of mechanical components is fixed to its corresponding one dichroic color mixing flag so that each mechanical component of the plurality of mechanical components extends from its first end at the first point inside the perimeter of the substantially circular shape of its corresponding one dichroic color mixing flag to its second end at a second point outside the perimeter of the substantially circular shape of its corresponding one dichroic color mixing flag, wherein the second end of each of the plurality of mechanical components is not overlapped by the substantially circular shape of its corresponding one dichroic color mixing flag;

and wherein the second end of each of the plurality of mechanical components is fixed to a corresponding one motor of the plurality of motors which is configured to a translate a dichroic color mixing flag of the plurality of dichroic color mixing flags into the light path of the multiparameter stage light; and wherein each of the dichroic color mixing flags is fixed to the first end of its corresponding one mechanical component and the second end of each of the corresponding mechanical components is fixed to its corresponding one motor of the plurality of motors so that each of the dichroic color mixing flags cannot rotate unless translated with respect to its corresponding one motor.

5. A dichroic color mixing system for a multiparameter stage light comprising:

a plurality of dichroic color mixing flags, each having a substantially rounded shape having a perimeter;

a plurality of motors each with a motor shaft, one corresponding motor for each of the plurality of dichroic color mixing flags; and a plurality of mechanical components, one corresponding mechanical component for each of the plurality of dichroic color mixing flags;

wherein at least two of the plurality of dichroic color mixing flags have the same transmitting color;

wherein each of the plurality of dichroic color mixing flags has a graduated area that produces a gradual color mixing when each of the plurality of dichroic color mixing flags is rotated by action of a motor shaft of one of the plurality of motors into a light path of the multiparameter stage light;

wherein a periphery of each of the plurality of dichroic color mixing flags is fixed to its corresponding one of the plurality of mechanical components in a manner so that each of the plurality of dichroic color mixing flags cannot rotate with respect to its corresponding one of the plurality of mechanical components;

wherein the periphery of each of the plurality of dichroic color mixing flags is fixed to the corresponding one of the plurality of mechanical components in a manner so that each mechanical component can move the dichroic color mixing flag which is fixed to it without moving any other dichroic color mixing flag;

wherein each mechanical component of the plurality of mechanical components has a first end which is fixed to and in direct contact with its corresponding one dichroic color mixing flag at a first point inside the perimeter of the substantially rounded shape of its corresponding one dichroic color mixing flag;

wherein each mechanical component of the plurality of mechanical components has a second end opposite the first end; and wherein each mechanical component of the plurality of mechanical components is fixed to its corresponding one dichroic color mixing flag so that each mechanical component of the plurality of mechanical components extends from its first end at the first point inside the perimeter of the substantially rounded shape of its corresponding one dichroic color mixing flag to its second end at a second point outside the periphery perimeter of the substantially rounded shape of its corresponding one dichroic color mixing flag, wherein the second end of each of the plurality of mechanical components is not overlapped by its corresponding one dichroic color mixing flag; and wherein the second end of each of the plurality of mechanical components is fixed to a corresponding motor shaft of its corresponding one of the plurality of motors which is configured to a translate its corresponding one dichroic color mixing flag of the plurality of dichroic color mixing flags into the light path of a multiparameter stage light; and wherein each of the dichroic color mixing flags is fixed to the first end of its corresponding one mechanical component and the second end of each of the corresponding mechanical components is fixed to its corresponding one motor of the plurality of motors so that each of the dichroic color mixing flags cannot rotate unless translated with respect to its corresponding one motor.

6. A method comprising configuring a dichroic color mixing system to function with a multiparameter stage light;

wherein the dichroic color mixing system includes a plurality of dichroic color mixing flags wherein each of the dichroic color mixing flags has a substantially circular shape having a perimeter and at least two of the plurality of dichroic color mixing flags have a transmitting color which is the same;

wherein a periphery of each of the plurality of dichroic color mixing flags is fixed to a corresponding one of a plurality of mechanical components in a manner so that each of the plurality of dichroic color mixing flags cannot rotate with respect to its corresponding one of the plurality of mechanical components;

wherein the periphery of each of the plurality of dichroic color mixing flags is fixed to the corresponding one of the plurality of mechanical components in a manner so that each mechanical component can move the dichroic color mixing flag which is fixed to it without moving any other dichroic color mixing flag;

wherein each mechanical component of the plurality of mechanical components has a first end which is fixed to and in direct contact with its corresponding one dichroic color mixing flag at a first point inside the perimeter of the substantially circular shape of its corresponding one dichroic color mixing flag;

wherein each mechanical component of the plurality of mechanical components has a second end opposite the first end; and wherein each mechanical component of the plurality of mechanical components is fixed to its corresponding one dichroic color mixing flag so that each mechanical component of the plurality of mechanical components extends from its first end at the first point inside the perimeter of the substantially circular shape of its corresponding one dichroic color mixing flag to its second end at a second point outside the perimeter of the substantially circular shape of its corresponding one dichroic color mixing flag, wherein the second end of each of the plurality of mechanical components is not overlapped by the substantially circular shape its corresponding one dichroic color mixing flag;

and wherein the second end of each of the plurality of mechanical components is fixed to a corresponding one motor of a plurality of motors each of which is configured to a translate a corresponding one dichroic color mixing flag of the plurality of dichroic color mixing flags; and wherein each of the dichroic color mixing flags is fixed to the first end of its corresponding one mechanical component and the second end of each of the corresponding mechanical components is fixed to its corresponding one motor of the plurality of motors so that each of the dichroic color mixing flags cannot rotate unless translated with respect to its corresponding one motor.

7. The method of claim 6 wherein wherein the transmitting color of the at least two of the dichroic color mixing flags is any one of magenta, cyan or yellow.

8. A method comprising configuring a dichroic color mixing system to function with a multiparameter stage light;

wherein the dichroic color mixing system includes a plurality of dichroic color mixing flags each having a shape and each having a transmitting color;

wherein the dichroic color mixing system includes a plurality of motors, one for each of the plurality of dichroic color mixing flags;

wherein the shape of each of the dichroic color mixing flags is substantially rounded in shape having a perimeter;

wherein at least two of the plurality of dichroic color mixing flags have the same transmitting color;

wherein each of the dichroic color mixing flags is configured with respect to its motor so that each of the dichroic color mixing flags can be translated into an optical path of the multiparameter stage light by its motor;

wherein a periphery of each of the plurality of dichroic color mixing flags is fixed to a corresponding one of a plurality of mechanical components in a manner so that each of the plurality of dichroic color mixing flags cannot rotate with respect to its corresponding one of the plurality of mechanical components;

wherein the periphery of each of the plurality of dichroic color mixing flags is fixed to the corresponding one of the plurality of mechanical components in a manner so that each mechanical component can move the dichroic color mixing flag which is fixed to it without moving any other dichroic color mixing flag;

wherein each of the plurality of mechanical components is fixed to a corresponding one of the plurality of motors;

wherein each mechanical component of the plurality of mechanical components has a first end which is fixed to and in direct contact with its corresponding one dichroic color mixing flag at a first point inside the perimeter of the substantially rounded shape of its corresponding one dichroic color mixing flag;

wherein each mechanical component of the plurality of mechanical components has a second end opposite the first end; and wherein each mechanical component of the plurality of mechanical components is fixed to its corresponding one dichroic color mixing flag so that each mechanical component of the plurality of mechanical components extends from its first end at the first point inside the periphery of its corresponding one dichroic color mixing flag to its second end at a second point outside the perimeter of the substantially rounded shape of its corresponding one dichroic color mixing flag, wherein the second end of each of the plurality of mechanical components is not overlapped by its corresponding one dichroic color mixing flag;

wherein the second end of each of the plurality of mechanical components is fixed to a its corresponding one of the plurality of motors which is configured to a translate its corresponding one dichroic color mixing flag of the plurality of dichroic color mixing flags into the optical path of the multiparameter stage light; and wherein each of the dichroic color mixing flags is fixed to the first end of its corresponding one mechanical component and the second end of each of the corresponding mechanical components is fixed to its corresponding one motor of the plurality of motors so that each of the dichroic color mixing flags cannot rotate unless translated with respect to its corresponding one motor.

9. A method comprising configuring a dichroic color mixing system to function with a multiparameter stage light;

wherein the dichroic color mixing system includes a plurality of dichroic color mixing flags, each having a shape which is substantially circular having a perimeter, and each having a transmitting color;

wherein at least two of the plurality of dichroic color mixing flags have the same transmitting color;

wherein each of the plurality of dichroic color mixing flags has a graduated area that produces a gradual color mixing when each of the plurality of dichroic color mixing flags is translated into a light path of the multiparameter stage light;

wherein a periphery of each of the plurality of dichroic color mixing flags is fixed to a corresponding one of a plurality of mechanical components in a manner so that each of the plurality of dichroic color mixing flags cannot rotate with respect to its corresponding one of the plurality of mechanical components;

wherein the periphery of each of the plurality of dichroic color mixing flags is fixed to the corresponding one of the plurality of mechanical components in a manner so that each mechanical component can move the dichroic color mixing flag which is fixed to it without moving any other dichroic color mixing flag;

wherein each mechanical component of the plurality of mechanical components has a first end which is fixed to and in direct contact with its corresponding one dichroic color mixing flag at a first point inside the perimeter of the substantially circular shape of its corresponding one dichroic color mixing flag;

wherein each mechanical component of the plurality of mechanical components has a second end opposite the first end; and wherein each mechanical component of the plurality of mechanical components is fixed to its corresponding one dichroic color mixing flag so that each mechanical component of the plurality of mechanical components extends from its first end at the first point inside the perimeter of the substantially circular shape of its corresponding one dichroic color mixing flag to its second end at a second point outside the perimeter of the substantially circular shape of its corresponding one dichroic color mixing flag, wherein the second end of each of the plurality of mechanical components is not overlapped by its corresponding one dichroic color mixing flag; and and wherein the second end of each of the plurality of mechanical components is fixed to its corresponding one motor of the plurality of motors which is configured to a translate a dichroic color mixing flag of the plurality of dichroic color mixing flags into the light path; and wherein each of the dichroic color mixing flags is fixed to the first end of its corresponding one mechanical component and the second end of each of the corresponding mechanical components is fixed to its corresponding one motor of the plurality of motors so that each of the dichroic color mixing flags cannot rotate unless translated with respect to its corresponding one motor.

* * * * *